US006403888B1

(12) United States Patent
Shukushima et al.

(10) Patent No.: US 6,403,888 B1
(45) Date of Patent: Jun. 11, 2002

(54) ELECTRIC WIRE

(75) Inventors: Satoshi Shukushima; Hiroshi Hayami; Kiyoaki Moriuchi, all of Osaka; Jingjing Gu, Kanuma; Takeshi Wakamiya, Kanuma; Kazuto Keta, Kanuma, all of (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/717,398

(22) Filed: Nov. 22, 2000

(30) Foreign Application Priority Data

Nov. 26, 1999 (JP) ..... 11-336136

(51) Int. Cl.[7] ..... H01B 7/00
(52) U.S. Cl. ..... 174/110 R; 524/265
(58) Field of Search ..... 174/110 R, 110 SR, 174/110 PM, 120 SR; 524/265, 436

(56) References Cited

U.S. PATENT DOCUMENTS

| | | | |
|---|---|---|---|
| 4,322,575 A | 3/1982 | Skipper | 174/120 |
| 4,353,817 A | 10/1982 | Hiroyuki et al. | 524/232 |
| 5,236,985 A | 8/1993 | Hayami | 524/265 |

FOREIGN PATENT DOCUMENTS

| | | |
|---|---|---|
| EP | 0 474 252 | 3/1992 |
| GB | 2 035 333 | 6/1980 |
| GB | 2 110 696 | 6/1983 |
| JP | 2525982 | 5/1996 |

*Primary Examiner*—Chau N. Nguyen
(74) *Attorney, Agent, or Firm*—Smith, Gambrell & Smith, LLP.

(57) ABSTRACT

The present invention relates to an electric wire having a conductor and a covering layer covering the conductor. The electric wire is inserted under pressure between two contact portions of a terminal of an insulation displacement connector to electrically connect to the terminal. In the present invention, the covering layer is made of a covering material obtained by irradiating with ionizing radiation a resin composition containing an ethylene copolymer and a metal hydroxide surface-treated with a predetermined silane compound. The 100% tensile modulus of the covering material is 7.8 MPa or more. The 100% tensile modulus and elongation satisfy $E1>270-8.5\times10^{-6}\times Y$ (where E1 is the elongation and Y is the 100% tensile modulus). In this case, removal of the electric wire once mounted in the insulation displacement connector can be prevented, and exposure of the conductor in the electric wire in inserting the electric wire under pressure between two contact portions of the terminal of the insulation displacement connector can be sufficiently prevented.

20 Claims, 3 Drawing Sheets

ELECTRIC WIRE

BACKGROUND OF THE INVENTION

1. Field of the Invention

The present invention relates to an electric wire used in wiring in equipment such as electronic equipment or the like and, more particularly, to an electric wire attached to a terminal of an insulation displacement connector.

2. Related Background Art

An electric wire for an insulation displacement connector generally comprises a stranded conductor obtained by twisting a plurality of conductor wires and a covering layer covering the stranded conductor. The end portion of the electric wire is inserted under pressure between two contact portions of a terminal of an insulation displacement connector having a plurality of terminals and two contact portions of the terminal on the sides of the electric wire penetrate the covering layer and contact the stranded conductor and are electrically connected to the stranded conductor. The insulation displacement connector has a wedged portion called strain relieves so as not to allow removal of the electric wire once accommodated (see reference numeral 6 in FIG. 2).

Polyvinyl chloride (referred to as "PVC" hereinafter) or the like was conventionally used as the material constituting the covering layer of the above-described electric wire for insulation displacement connector because PVC is inexpensive and excellent in workability. However, PVC produces a toxic halogen gas during combustion and may generate very toxic dioxin during incineration for disposal. Also, the U.S. UL (Underwire Laboratories Inc.) standard requires that the electric wire should have a certain degree of fire retardancy. Therefore, a material which does not produce toxic gases such as a halogen gas or the like and has a certain degree of fire retardancy is required as the material constituting the covering layer of the electric wire.

Under these circumstances, for example, as described in Japanese Patent No. 2525982, a resin composition including a fire retardant such as aluminum hydroxide or magnesium hydroxide or the like in a polyolefin resin is irradiated with ionizing radiation, and the resultant material is used as the material for the covering layer.

SUMMARY OF THE INVENTION

The present inventors have found that use of the material disclosed in the prior-art reference as the covering layer of an electric wire for an insulation displacement connector suffers the following problem.

Namely, according to the findings of the present inventors, as shown in FIG. 1, when an electric wire 3 is inserted under pressure between two contact portions 2 of a terminal of an insulation displacement connector 1 to bring a conductor 4 in electric wire 3 into contact with two contact portions 2 of the terminal, a covering layer 5 tears to expose conductor 4 in electric wire 3 and this may cause the short-circuit in the connector. As shown in FIG. 2, covering layer 5 deforms and electric wire 3 cannot be properly mounted in connector 1. Electric wire 3 once mounted may be removed.

It is an object of the present invention to provide an electric wire capable of sufficiently preventing removal of the electric wire from an insulation displacement connector and sufficiently preventing exposure of the conductor.

The present inventors have made extensive studies to solve the above problems. Namely, as to whether in electric wires having covering layers made of various materials, conductors are exposed (referred to as "core exposure" hereinafter), or the covering layers deform (referred to as "covering layer deformation" hereinafter) when electric wires for insulation displacement connectors are inserted under pressure between two contact portions of a terminal of insulation displacement connectors, the present inventors have conducted investigations by calculating the frequencies of "core exposure" and "covering layer deformation" occurring in the electric wires for evaluation. The relative relationship between this result and the 100% tensile modulus and elongation of the covering material was examined. The result is shown in FIG. 3. In FIG. 3, when the frequency of "core exposure" or "covering layer deformation" is 1/20 or less, the result is determined as "good" and indicated by "○". When the frequency is higher than 1/20, the result is determined as "poor" and indicated by "▲" for "covering layer deformation", and "×" for "core exposure". Also, in FIG. 3, G100 represents Y=7.8, while G200 represents $E_1=270-8.5\times10^{-6}\times Y$. A stranded conductor whose conductor size is AWG26 (obtained by twisting seven tinned wires each having a diameter of 0.16 mm) was used as a conductor of an electric wire for insulation displacement connectors. Covering layer is obtained by covering a resin composition having a predetermined composition and extruded by an 50-mm diameter extruder on the stranded conductor to have a conductor outer diameter of 0.98 mm, and then irradiating an electron beam at predetermined doses to the resin composition. Also, a JST DA connector having 5 terminals arrayed at the pitch of 2 mm (manufactured by JST Mfg Co., Ltd) was used as an insulation displacement connector.

The present inventors have found that the above problems in prior art can be solved by using a covering material such that its 100% tensile modulus and elongation satisfy predetermined conditions, thus accomplishing the present invention.

Namely, the electric wire of the present invention comprises a conductor and a covering layer covering the conductor, the conductor being brought into contact with two contact portions of a terminal by inserting the electric wire under pressure between two contact portions of the terminal of an insulation displacement connector, wherein the covering layer is made of a covering material obtained by irradiating with ionizing radiation a resin composition containing an ethylene copolymer and a metal hydroxide surface-treated with a silane compound represented by:

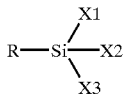

(where R represents an alkyl group having an acrylic, methacrylic, or allyl group, a saturated alkyl group, a vinyl group, an epoxy group, an amino group, or a mercapto group; X1, X2, and X3 represent alkoxy or alkyl groups, respectively; and at least one of X1, X2, and X3 represents an alkoxy group), a 100% tensile modulus of the covering material is not less than 7.8 MPa, and the 100% tensile modulus and an elongation of the covering material satisfies the following relationship:

$$E1>270-8.5\times10^{-6}\times Y$$

(where E1 is the elongation and Y is the 100% tensile modulus).

According to the present invention, in inserting under pressure the electric wire between two contact portions of the terminal of the insulation displacement connector, the electric wire can be reliably mounted in the insulation displacement connector without deforming the covering layer, and the removal of the electric wire once mounted can be prevented. Also, damage to the covering layer and exposure of the conductor can be sufficiently prevented.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

An electric wire according to the present invention will be described with reference to FIGS. 4 and 5.

Figure 1:
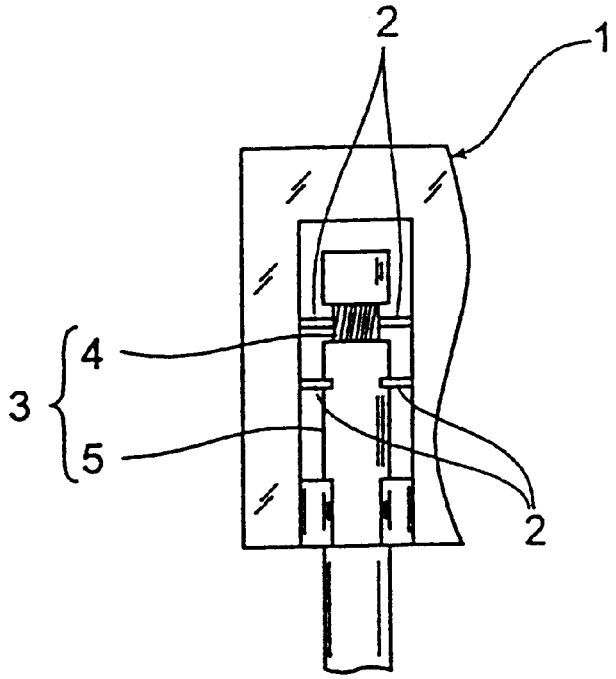
Fig.1 PRIOR ART
FIG. 1 is a plan view showing a comparative example for explaining the effect of an electric wire of the present invention, and showing "core exposure" occurring in the electric wire.
Figure 2:
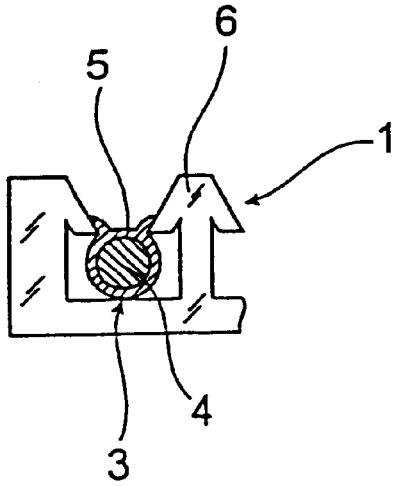
Fig.2 PRIOR ART
FIG. 2 is a side view showing another comparative example for explaining the effect of the electric wire of the present invention, and showing "covering layer deformation" occurring in the electric wire.
Figure 3:
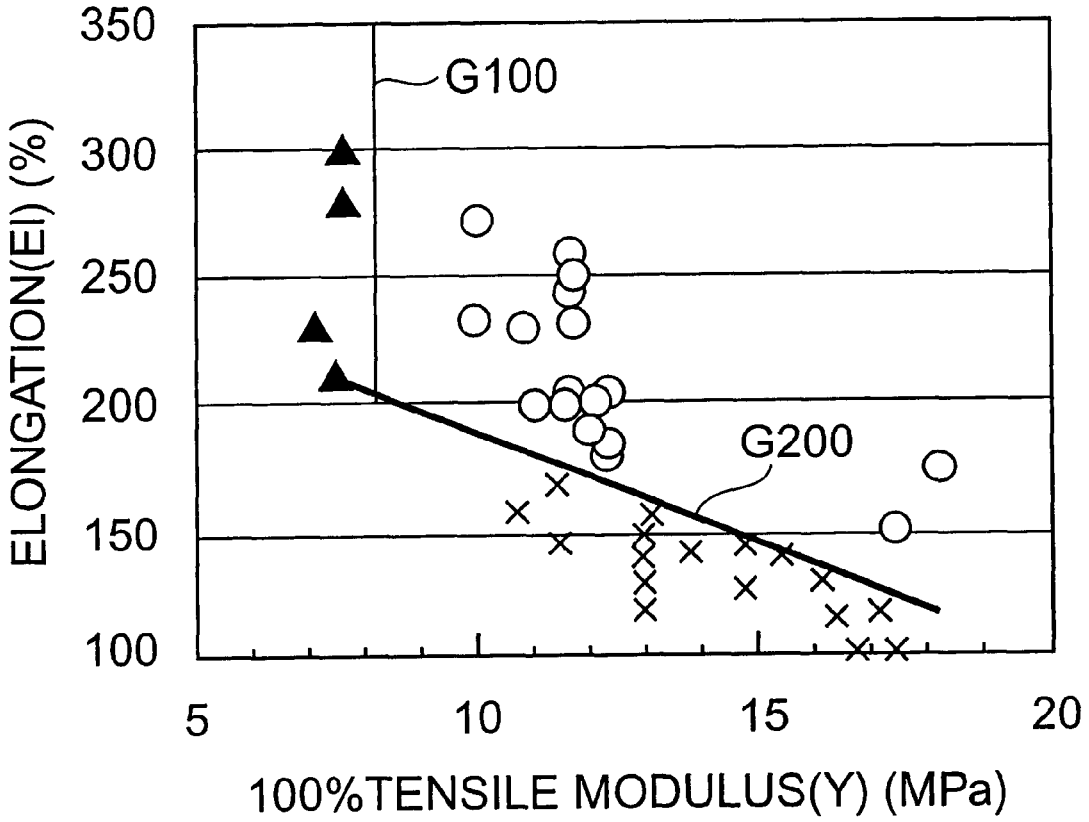
FIG. 3 is a graph showing the relative relationship between 100% tensile modulus, elongation, and evaluation of insulation displacement workability of various electric wires.
Figure 4:
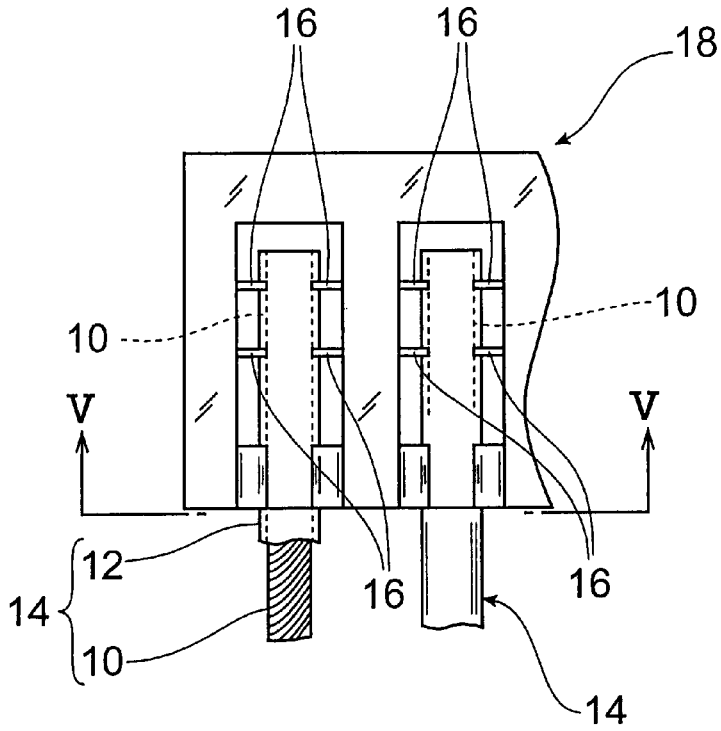
FIG. 4 is a plan view showing the electric wire of the present invention mounted in an insulation displacement connector.
Figure 5:
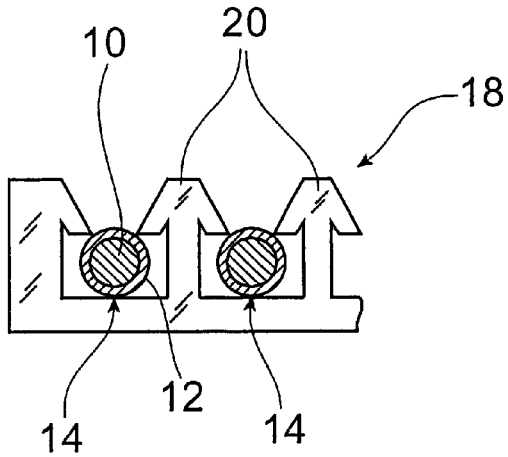
FIG. 5 is a sectional view taken along the line V—V in FIG. 4.

As shown in FIGS. 4 and 5, electric wires 14 of the present invention comprise a conductor 10 and a covering layer 12 covering conductor 10. According to electric wire 14 of the present invention, when the end portion of electric wire 14 is inserted under pressure between two contact portions 16 of a terminal of an insulation displacement connector 18 and between strain relieves 20, electric wire 14 can be reliably mounted in insulation displacement connector 18 without deforming covering layer 12, and the removal of electric wire 14 once mounted can be prevented. Also, damage to covering layer 12 and exposure of conductor 10 can be sufficiently prevented.

Conductor 10 used in the present invention may be a single-wire conductor comprised of a single conductor wire or a stranded conductor obtained by twisting a plurality of conductor wires. When a stranded conductor is used, the number of wires is generally 7 to 43 and preferably 7. When the electric wire comprising a 7-wire stranded conductor is mounted in the terminal of the insulation displacement connector, the contact area between the conductor and the terminal can be increased, thereby further improving connection reliability. The conductor wire is not particularly limited if it is conductive. Examples of the conductor wire are an annealed copper wire, a hard-drawn copper wire, an annealed copper tinned wire, a copper-tin alloy wire, a copper-plated steel wire, and a noble metal wire.

The diameter of conductor 10 is appropriately selected depending on the terminal pitch of insulation displacement connector 18 used. Namely, an electric wire comprising a conductor having a conductor size of AWG32 or AWG30 is used for an insulation displacement connector having a terminal pitch of 1 mm; an electric wire comprising a conductor having a conductor size of AWG30 or AWG28 is used for an insulation displacement connector having a terminal pitch of 1.5 mm; an electric wire comprising a conductor having a conductor size of AWG28 or AWG26 is used for an insulation displacement connector having a terminal pitch of 2.0 mm; an electric wire comprising a conductor having a conductor size of AWG28, AWG26 or AWG24 is used for an insulation displacement connector having a terminal pitch of 2.5 mm; and an electric wire comprising a conductor having a conductor size of AWG26, AWG24, AWG22, AWG20, or AWG18 is used for an insulation displacement connector having a terminal pitch of 3.96 mm.

Covering layer 12 used in the present invention is made of a covering material. The 100% tensile modulus of this covering material is 7.8 MPa or more. Here, the 100% tensile modulus means a tensile strength at the 100% elongation when the covering layer is pulled at an inter-chuck distance of 50 mm, a distance of 20 mm between two gage marks, and a stress rate of 500 mm/min using a tensile test machine("tensilon" manufactured by Orientec Inc.). When the 100% tensile modulus of this covering material is less than 7.8 MPa, covering layer 12 deforms when the end portion of electric wire 14 is mounted in insulation displacement connector 18 because the covering material is soft. The lower limit of the 100% tensile modulus is preferably 9 MPa, and more preferably 10 MPa. On the other hand, the upper limit of the 100% tensile modulus of the covering material is preferably 50 MPa.

The 100% tensile modulus (Pa) and the elongation (%) of the covering material used in the present invention satisfy the following relational expression:

$$E1>270-8.5\times10^{-6}\times Y \quad (1)$$

(where E1 is the elongation and Y is the 100% tensile modulus). Here, the elongation means an elongation when the covering layer 12 is pulled until it breaks using the tensile test machine described above. When the elongation and 100% tensile modulus of the covering material do not satisfy the above expression (1), covering layer 12 cracks to expose the conductor.

A covering material satisfying the above relationship is obtained by irradiating with ionizing radiation a resin composition containing an ethylene copolymer and a metal hydroxide surface-treated with a silane compound represented by the following general formura:

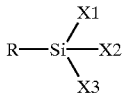

(wherein R represents an alkyl group having an acrylic, methacrylic, or allyl group, a saturated alkyl group, a vinyl group, an epoxy group, an amino group, or a mercapto group; X1, X2, and X3 represent alkoxy or alkyl groups, respectively; and at least one of X1, X2, and X3 represents an alkoxy group).

In the present invention, the ethylene copolymer means a copolymer of ethylene and other monomer(s). Examples of the ethylene copolymer are an ethylene-vinyl acetate copolymer, an ethylene-ethyl acrylate copolymer, an ethylene-methyl acrylate copolymer, an ethylene-α-olefin copolymer, or a mixture thereof.

Examples of the metal hydroxide contained in the covering material of the present invention are magnesium hydroxide, aluminum hydroxide or the like.

In the resin composition used in the present invention, 90 to 250 parts by weight of a metal hydroxide are preferably added to 100 parts by weight of the ethylene copolymer. When the added amount of the metal hydroxide is less than 90 parts by weight, fire retardancy of the covering layer tends to be insufficient. When the added amount of the metal hydroxide is more than 250 parts by weight, mechanical properties of the covering layer tends to degrade.

The silane compound represented by the above general formula is a material generally called a silane coupling agent and is used for surface-treating a metal hydroxide. A metal hydroxide is surface-treated with the above silane compound so as to improve the mechanical characteristics of the covering layer. The surface treatment of the metal hydroxide with the silane compound can be performed by a known method. For example, a predetermined amount of a silane compound is dispersed in water so as to obtain a concentration of 0.1% to several %, and the pH of the aqueous solution is adjusted as required, thereafter a predetermined amount of a metal hydroxide is dipped in the aqueous solution, and the resultant solution is stirred to obtain a slurry. The slurry is filtered, heated, and dried to obtain metal hydroxide surface-treated with the silane compound. Also, the metal hydroxide can be surface-treated by mixing the metal hydroxide, which has not been surface-treated, with ethylene copolymer and a silane compound using a roll mixer or the like (integral blending method).

Examples of the silane compound are alkoxysilanes (e.g., methyltrimethoxysilane, dimethyltrimethoxysilane, trimethylmethoxysilane, methyltriethoxysilane, ethyltrimethoxysilane, and ethyltriethoxysilane, butyltrimethoxysilane), acrylsilanes (e.g., γ-methacryloxypropyltrimethoxysilane), vinyl silanes (e.g., vinyltri(βmethoxyethoxy)silane, vinyltriethoxysilane and vinyltrimethoxysilane), epoxy silanes (e.g., β-(3,4-epoxycyclohexyl)ethyltrimethoxysilane, γ-glycidoxypropyltrimethoxysilane, and γ-glycidoxypropylmethyldiethoxysilane), aminosilanes (e.g., N-β(aminoethyl)γ-aminopropyltrimethoxysilane, N-β(aminoethyl)γ-aminopropylmethyldimethoxysilane, γ-aminopropyltriethoxysilane, N-phenyl-γ-aminopropyltrimethoxysilane), and mercapto silanes (e.g., γ-mercaptopropyltrimethoxysilane).

The added amount of the silane compound in the resin composition is preferably 0.2 to 2.0 parts by weight to 100 parts by weight of a metal hydroxide. When the added amount of the silane compound is less than 0.2 parts by weight, mechanical properties of the covering layer tend to be insufficient. When the added amount of the silane compound exceeds 2.0 parts by weight, the upper portion of the covering layer tends to crack to expose the conductor when the end portion of the electric wire is inserted under pressure between two contact portions of the terminal of the insulation displacement connector.

The above resin composition may contain other polymer different from the ethylene copolymer, for example, polyethylene (e.g., high-density polyethylene), polypropylene, ethylene-propylene rubber. The resin composition may contain the above silane compound singly together with the metal hydroxide surface-treated with a silane compound. In addition, the resin composition may contain various thermal stabilizers, ultraviolet absorbing agents, lubricants, antioxidants, coloring agents, foaming agents, working stabilizers, organic or inorganic fillers or the like as required. To increase the crosslinking efficiency in irradiation with ionizing radiation, the resin composition may contain a crosslinking assistant such as trimethylolpropantrimethacrylate, pentaerythritoltriacrylate, ethylene glycol dimethacrylate, triallylcyanurate, triallylisocyanurate or the like.

The above resin composition is melted and kneaded using a monoaxial extruder, multi-axial extruder, Banbury mixer, roll, kneader, or the like and is extruded in the form of a tube to cover the conductor.

A γ-ray or electron beam is used as the ionizing radiation for irradiating the resin composition. The 100% tensile modulus and elongation of the resultant covering material can be controlled to satisfy the above expression (1) by adjusting a dose of the ionizing radiation.

Here, the dose of the ionizing radiation is different depending on the hardness of the resin composition and the added amount of the silane compound to the resin composition, but it is preferably within the range of 20 to 130 kGy. If the dose is less than 20 kGy, the holding force of the terminal of the insulation displacement connector for the electric wire tends to deteriorate upon use over a long period of time because three-dimensional crosslinking is insufficient in the resultant covering material, thereby the covering layer easily deforms. When the dose exceeds 130 kGy, the covering layer tends to easily crack to expose the conductor.

Here, when the added amount of silane compound to metal hydroxide is expressed by A (parts by weight), the resin composition is preferably irradiated with the ionizing radiation at a dose not more than a dose represented by the following expression (2) and within the above-described range of dose of ionizing radiation:

$$(180-100\times A)(\text{kGy}) \quad (2)$$

The reason is: although the higher the dose of the ionizing radiation on the resin composition and the higher the added amount of the silane compound, the easier the covering layer cracks when the electric wire is mounted in the insulation displacement connector, generation of cracks in the covering layer can be sufficiently prevented at the time of mounting the electric wire to the insulation displacement connector when the resin composition is irradiated with the ionizing radiation at the dose represented by the above expression (2).

In the covering material obtained by irradiating the resin composition with the ionizing radiation, the gel fraction G of a portion excluding inorganic substances including the metal hydride from the covering material is preferably 55% to 85%.

When the gel fraction G is less than 55%, the holding force of the terminal of the insulation displacement connector tends to deteriorate for a long period of time because three-dimensional crosslinking is insufficient in the covering material, the covering layer easily deforms. When the gel fraction G exceeds 85%, the covering layer tends to easily crack to expose the conductor.

The gel fraction is an index representing the degree of crosslinking. The gel fraction means the ratio of gel (insoluble polymer chains) contained in a portion excluding inorganic substances including a metal hydride from the covering material insoluble in the solvent such as xylene or the like. The gel fraction G (%) is represented by the following expression:

$$G(\%)=(G'-M)\times 100/(100\times M)$$

(where G' is the apparent gel fraction (%) and M is the weight (%) of the inorganic substances such as a metal hydroxide or the like in the covering material. The apparent gel fraction G' (%) can be represented by the following expression:

$$G'(\%)=(\text{weight of covering material after extracting solvent})\times 100/(\text{weight of covering material before solvent extraction})).$$

The insulation displacement connector to which the electric wire of the present invention is mounted is not particularly limited and may be any kind of connector, for example, a variety of insulation displacement connectors manufactured by JST Mfg Co., Ltd (JST) and Tyco electronics AMP K.K. (AMP) can be used as an insulation displacement connector. The insulation displacement connectors have 2 to 16 terminals, and an insulation displacement connector with an appropriate number of terminals can be used. Further, the terminal pitch of the insulation displacement connectors ranges from 1.0 mm to 3.96 mm. An insulation displacement connector having an appropriate terminal pitch is used depending on the type of the electric wire used.

The contents of the present invention will be described in more detail by way of its examples.

EXAMPLES

Example 1

As shown in Table 1, a stranded conductor whose conductor size was AWG26 (obtained by twisting seven tinned conductor wires each having a diameter of 0.16 mm) was used as a conductor. On the other hand, a resin composition (blend 1) shown in Table 2 was obtained using a 6 inch roll heated to about 140° C.

Thus obtained resin composition was extruded using a 50-mm diameter extruder. In the above resin composition, N-β(aminoethyl) γ-aminopropyltrimethoxysilane was used as an aminosilane to be used in the surface-treatment of magnesium hydroxide and the amount of the aminosilane for surface treatment was 0.8 parts by weight to 100 parts by weight of magnesium hydroxide. The resin composition thus extruded was covered on the above stranded conductor so that the covering layer had a diameter of 0.98 mm. This resin composition was irradiated with an electron beam at an acceleration voltage of 1 MeV using an electron beam accelerator at a dose shown in Table 1, thereby obtaining an electric wire for insulation displacement connector (No. 1).

Insulation displacement workability of this electric wire was evaluated as follows. First, 100 electric wires were subjected to insulation displacement in the terminals of 20 insulation displacement connectors. Here, as the insulation displacement connectors to which the electric wires are subjected to insulation displacement, JST KR connectors each having 5 terminals aligned at a pitch of 2 mm (manufactured by JST Mfg Co., Ltd) were used. Electric wires were subjected to insulation displacement in the insulation displacement connectors using a JST hand press type insulation displacement machine.

It was examined whether "core exposure" and "covering layer deformation" occur in the electric wires. Further, the number (frequency) of electric wires where "core exposure" or "covering layer deformation" occurs among all evaluated electric wires was calculated. If the frequency is not more than 1/100, the electric wire was evaluated as "very good" and indicated by "◎", and if the frequency is more than 1/100 and not more than 1/20, the electric wire was evaluated as "good" and indicated by "○". When the frequency is more than 1/20, the electric wire was evaluated as "poor" and described as "covering layer deformation" or "core exposure". The result is shown in Table 1.

TABLE 1

| | EXAMPLE1 | EXAMPLE2 | EXAMPLE3 | EXAMPLE4 | EXAMPLE5 | EXAMPLE6 |
|---|---|---|---|---|---|---|
| NUMBER OF CONDUCTOR WIRE(s) | 7 | 7 | 7 | 7 | 7 | 7 |
| DIAMETER OF CONDUCTOR WIRE (mm) | 0.16 | 0.16 | 0.16 | 0.16 | 0.16 | 0.16 |
| CONDUCTOR SIZE (AWG) | 26 | 26 | 26 | 26 | 26 | 26 |

TABLE 1-continued

| | EXAMPLE1 | EXAMPLE2 | EXAMPLE3 | EXAMPLE4 | EXAMPLE5 | EXAMPLE6 |
|---|---|---|---|---|---|---|
| BLEND | BLEND 1 | BLEND 1 | BLEND 1 | BLEND 1 | BLEND 1 | BLEND 2 |
| ADDED AMOUNT OF SILANE COMPOUND A (PARTS BY WT.) | 0.8 | 0.8 | 0.8 | 0.8 | 0.8 | 1.3 |
| ELECTRON BEAM DOSE (KGY) | 50 | 50 | 50 | 50 | 50 | 50 |
| 180-100 × A (KGY) | 100 | 100 | 100 | 100 | 100 | 50 |
| GEL FRACTION (%) | 60 | 60 | 60 | 60 | 60 | 65 |
| OUTER DIAMETER OF COVERING LAYER (mm) | 0.98 | 0.98 | 0.98 | 0.98 | 0.98 | 0.98 |
| 100% TENSILE MODULUS Y (MPA) | 11.5 | 11.5 | 11.5 | 11.5 | 11.5 | 11.9 |
| $270-8.5 \times 10^{-6} \times Y$ | 173 | 173 | 173 | 173 | 173 | 170 |
| ELONGATION EL (%) | 250 | 250 | 250 | 250 | 250 | 200 |
| ELECTRIC WIRE NO. | 1 | 1 | 1 | 1 | 1 | 2 |
| CONNECTOR USED | JST KR | JST DA | AMP CT | AMP IN-V | AMP IN-H | JST KR |
| COVERING LAYER DEFORMATION (COUNT OF ELECTRIC WIRE) | 0 | 0 | 0 | 0 | 0 | 0 |
| CORE EXPOSURE (COUNT OF ELECTRIC WIRE) | 0 | 0 | 0 | 0 | 0 | 2 |
| EVALUATION OF INSULATION DISPLACEMENT WORKABILITY | ◎ | ◎ | ◎ | ◎ | ◎ | ○ |

TABLE 2

| | BLEND 1 | BLEND 2 | BLEND 3 | BLEND 4 | BLEND 5 | BLEND 6 | BLEND 7 | BLEND 8 |
|---|---|---|---|---|---|---|---|---|
| EVA (VA = 33 WT %) | 100 | 100 | 100 | 90 | 100 | 100 | | 100 |
| EVA (VA = 28 WT %) | | | | | | | | |
| EVA (VA = 19 WT %) | | | | | | | 100 | |
| HDPE (MI = 0.8) | | | | 10 | | | | |
| MAGNESIUM HYDROXIDE SURFACE-TREATED WITH AMINOSILANE (ADDED AMOUNT OF AMINOSILANE) | 200 (1.6) | 200 (1.6) | | | | 120 (0.96) | 200 (1.6) | |
| MAGNESIUM HYDROXIDE SURFACE-TREATED WITH VINYLSILANE (ADDED AMOUNT OF VINYLSILANE) | | | 200 (1.6) | | | | | |
| MAGNESIUM HYDROXIDE NOT SURFACE-TREATED (ADDED AMOUNT OF AMINOSILANE) | | | | 200 | | | | 200 |
| MAGNESIUM HYDROXIDE SURFACE-TREATED WITH AMINOSILANE (ADDED AMOUNT OF AMINOSILANE) | | | | | 200 (1.6) | | | |
| BASIC MAGNESIUM CARBIDE | | | | | | | | |
| IRUGANOX 1010 | 1 | 1 | 1 | 1 | 1 | 1 | 1 | 1 |
| STEARIC ACID | 0.5 | 0.5 | 0.5 | 0.5 | 0.5 | 0.5 | 0.5 | 0.5 |
| γ-METHACRYLOXYPROPYLTRIMETHOXYSILANE | | 1 | | 1 | | | | |
| ADDED AMOUNT OF SILANE TO 100 PARTS BY WEIGHT OF METAL HYDROXIDE | 0.8 | 1.3 | 0.8 | 0.5 | 0.8 | 0.8 | 0.8 | 0 |

| | BLEND 9 | BLEND 10 | BLEND 11 | BLEND 12 | BLEND 13 | BLEND 14 |
|---|---|---|---|---|---|---|
| EVA (VA = 33 WT %) | 100 | 100 | 100 | | | 100 |
| EVA (VA = 28 WT %) | | | | 100 | 100 | |
| EVA (VA = 19 WT %) | | | | | | |
| HDPE (MI = 0.8) | | | | | | |
| MAGNESIUM HYDROXIDE SURFACE-TREATED WITH AMINOSILANE (ADDED AMOUNT OF AMINOSILANE) | 200 (1.6) | 80 (0.64) | 260 (2.06) | | | |
| MAGNESIUM HYDROXIDE SURFACE-TREATED WITH VINYLSILANE (ADDED AMOUNT OF VINYLSILANE) | | | | | | |

TABLE 2-continued

| | | | | | | |
|---|---|---|---|---|---|---|
| MAGNESIUM HYDROXIDE NOT SURFACE-TREATED (ADDED AMOUNT OF AMINOSILANE) | | | | 200 | 180 | 170 |
| MAGNESIUM HYDROXIDE SURFACE-TREATED WITH AMINOSILANE (ADDED AMOUNT OF AMINOSILANE) | | | | | | |
| BASIC MAGNESIUM CARBIDE | | | | | | 20 |
| IRUGANOX 1010 | 1 | 1 | 1 | 1 | 1 | 1 |
| STEARIC ACID | 0.5 | 0.5 | 0.5 | | | |
| γ-METHACRYLOXYPROPYLTRIMETHOXYSILANE | 3 | | | 2 | 3 | 3 |
| ADDED AMOUNT OF SILANE TO 100 PARTS BY WEIGHT OF METAL HYDROXIDE | 2.3 | 0.8 | 0.8 | 1.5 | 1.7 | 18 |

As shown in Table 1, no covering layer deformation and no core exposure occurred in all the electric wires, and insulation displacement workability was found to be very good.

Example 2

Insulation displacement workability of an electric wire (No. 1) was evaluated in the same manners as in Example 1 except that JST DA connectors each having 5 terminals aligned at a pitch of 2 mm (manufactured by JST Mfg Co., Ltd) were used as insulation displacement connectors. The result is shown in Table 1. As shown in Table 1, no covering layer deformation and no core exposure occurred in all the electric wires. Insulation displacement workability was found to be very good.

Example 3

Insulation displacement workability of an electric wire (No. 1) was evaluated in the same manners as in Example 1 except that AMP CT connectors each having 5 terminals aligned at a pitch of 2 mm (manufactured by Tyco Electronics AMP K.K.) were used as the insulation displacement connectors. The result is shown in Table 1. As shown in Table 1, no covering layer deformation and no core exposure occurred in all the electric wires. Insulation displacement workability was found to be very good.

Example 4

Insulation displacement workability of an electric wire (No. 1) was evaluated in the same manners as in Example 1 except that AMP IN-V connectors each having 5 terminals aligned at a pitch of 2 mm (manufactured by Tyco Electronics AMP K.K.) were used as insulation displacement connectors and the electric wires were subjected to insulation displacement using an AMP piston tool. The result is shown in Table 1. As shown in Table 1, no covering layer deformation and no core exposure occurred in all the electric wires. Insulation displacement workability was found to be very good.

Example 5

Insulation displacement workability of an electric wire (No. 1) was evaluated in the same manners as in Example 1 except that AMP IN-H connectors each having 5 terminals aligned at a pitch of 2 mm (manufactured by Tyco Electronics AMP K.K.) were used as insulation displacement connectors. The result is shown in Table 1. As shown in Table 1, no covering layer deformation and no core exposure occurred in all the electric wires. Insulation displacement workability was found to be very good.

Example 6

An electric wire (No. 2) was manufactured in the same manners as in Example 1 except that a resin composition further containing γ-methacryloxypropylmethoxysilane (blend 2) was used. Insulation displacement workability of the electric wire was evaluated in the same manners as in Example 1. The result is shown in Table 1. Although core exposure occurred in some electric wires, no covering layer deformation occurred in all the electric wires. Insulation displacement workability was found to be good.

Example 7

An electric wire (No. 3) was manufactured in the same manners as in Example 1 except that a resin composition (blend 3) containing magnesium hydroxide surface-treated with a vinyl silane (vinyltris(β-methoxyethoxy)silane) in place of magnesium hydroxide surface-treated with aminosilane was used, the dose of an electron beam was doubled for this resin composition, and the outer diameter of the covering layer was increased to 1.28 mm. Further, insulation displacement workability of the electric wire was evaluated in the same manners as in Example 1 except that JST HR connectors having 5 terminals aligned at a pitch of 2.5 mm (manufactured by JST Mfg Co., Ltd) were used as insulation displacement connectors. The result is shown in Table 3.

TABLE 3

| | EXAMPLE7 | EXAMPLE8 | EXAMPLE9 | EXAMPLE10 | EXAMPLE11 |
|---|---|---|---|---|---|
| NUMBER OF CONDUCTOR WIRE(s) | 7 | 7 | 7 | 7 | 7 |
| DIAMETER OF CONDUCTOR WIRE (mm) | 0.16 | 0.16 | 0.16 | 0.127 | 0.16 |
| CONDUCTOR SIZE (AWG) | 26 | 26 | 26 | 28 | 26 |
| BLEND | BLEND 3 | BLEND 10 | BLEND 5 | BLEND 6 | BLEND 4 |
| ADDED AMOUNT OF SILANE COMPOUND A (PARTS BY WT.) | 0.8 | 0.8 | 0.8 | 0.8 | 0.5 |
| ELECTRON BEAM DOSE (KGY) | 100 | 50 | 50 | 50 | 50 |
| 180-100 × A (KGY) | 100 | 100 | 100 | 100 | 130 |
| GEL FRACTION (%) | 74 | 62 | 59 | 62 | 58 |
| OUTER DIAMETER OF COVERING LAYER (mm) | 0.98 | 0.98 | 0.98 | 0.98 | 0.98 |
| 100 % TENSILE MODULUS Y (MPA) | 11.8 | 14.7 | 10.6 | 10.8 | 11.3 |
| $270-8.5 \times 10^{-6} \times Y$ | 170 | 146 | 180 | 179 | 175 |
| ELONGATION E1 (%) | 190 | 260 | 230 | 200 | 200 |
| ELECTRIC WIRE NO. | 3 | 12 | 5 | 6 | 4 |
| CONNECTOR USED | JST HR | JST KR | JST DA | AMP IN-V | AMP CT |
| COVERING LAYER DEFORMATION (COUNT OF ELECTRIC WIRE) | 0 | 0 | 0 | 0 | 0 |
| CORE EXPOSURE (COUNT OF ELECTRIC WIRE) | 1 | 0 | 0 | 0 | 0 |
| EVALUATION OF INSULATION DISPLACEMENT WORKABILITY | ◎ | ◎ | ◎ | ◎ | ◎ |

As shown in Table 3, core exposure occurred in some electric wires, but no covering layer deformation occurred in all the electric wires. Insulation displacement workability was found to be very good.

Example 8

An electric wire (No. 12) was manufactured in the same manners as in Example 1 except that a resin composition (blend 10), in which the added amount of. magnesium hydroxide surface-treated with aminosilane, was reduced to 80 parts by weight, was used. Insulation displacement workability of this electric wire was evaluated in the same manners as in Example 2. The result is shown in Table 3. As shown in Table 3, no covering layer formation and no core exposure occurred in all the electric wires, and insulation displacement workability was found to be very good.

Example 9

An electric wire (No. 5) was manufactured in the same manners as in Example 1 except that a resin composition (blend 5) containing aluminum hydroxide surface-treated with aminosilane in place of magnesium hydroxide surface-treated with aminosilane was used. Insulation displacement workability of this electric wire was evaluated in the same manners as in Example 2. The result is shown in Table 3. As shown in Table 3, no covering layer deformation and no core exposure occurred in all the electric wires, and insulation displacement workability was found to be very good.

Example 10

An electric wire (No. 6) was manufactured in the same manners as in Example 1 except that a resin composition (blend 6), in which the added amount of magnesium hydroxide surface-treated with aminosilane was reduced to 120 parts by weight, was used and the conductor had the conductor size, conductor wire diameter, and the outer diameter of the covering layer diameter shown in Table 1. Insulation displacement workability of this electric wire was evaluated in the same manners as in Example 4. The result is shown in Table 3. As shown in Table 3, no covering layer deformation and no core exposure occurred in all the electric wires, and insulation displacement workability was found to be very good.

Example 11

An electric wire (No. 4) was manufactured in the same manners as in Example 2 except that a resin composition (blend 4) containing magnesium hydroxide not surface-treated with a silane compound and a mixture of EVA and high-density polyethylene (HDPE) as an ethylene copolymer was used. Insulation displacement workability of this electric wire was evaluated in the same manners as in Example 3. The result is shown in Table 3. As shown in Table 3, even in an electric wire using a resin composition obtained by blending a silane compound using the integral blending method and then surface-treating the metal hydroxide with the silane compound, no core exposure and no covering layer deformation occurred in all the electric wires, and insulation displacement workability was found to be very good.

Comparative Example 1

An electric wire (No. 7) was manufactured in the same manners as in Example 1, except that the resin composition (blend 1) was not irradiated with an electron beam. Insulation displacement workability of this electric wire was evaluated in the same manners as in Example 1. The result is shown in Table 4.

TABLE 4

| | COMPARATIVE EXAMPLE 1 | COMPARATIVE EXAMPLE 2 | COMPARATIVE EXAMPLE 3 | COMPARATIVE EXAMPLE 4 | COMPARATIVE EXAMPLE 5 |
|---|---|---|---|---|---|
| NUMBER OF CONDUCTOR WIRE(s) | 7 | 7 | 7 | 7 | 7 |
| DIAMETER OF CONDUCTOR WIRE(mm) | 0.16 | 0.16 | 0.16 | 0.16 | 0.16 |
| CONDUCTOR SIZE (AWG) | 26 | 26 | 26 | 26 | 26 |
| BLEND | BLEND 1 | BLEND 1 | BLEND 7 | BLEND 8 | BLEND 9 |
| ADDED AMOUNT OF SILANE COMPOUND A (PARTS BY WT.) | 0.8 | 0.8 | 0.8 | 0 | 2.3 |
| ELECTRON BEAM DOSE (KGY) | 0 | 300 | 50 | 50 | 50 |
| 180-100 × A (KGY) | 100 | 100 | 100 | 180 | −50 |
| GEL FRACTION (%) | 0 | 86 | 60 | 57 | 63 |
| OUTER DIAMETER OF COVERING LAYER (mm) | 0.98 | 0.98 | 0.98 | 0.98 | 0.98 |
| 100% TENSILE MODULUS Y(MPA) | 7.35 | 12.8 | 12.8 | 6.86 | 12.8 |
| $270-8.5 \times 10^{-6} \times Y$ | 208 | 162 | 162 | 212 | 162 |
| ELONGATION EL (%) | 300 | 130 | 150 | 230 | 120 |
| ELECTRIC WIRE NO. | 7 | 8 | 9 | 10 | 11 |
| CONNECTOR USED | JST KR | AMP IN-V | JST KR | AMP IN-V | JST KR |
| COVERING LAYER DEFORMATION (COUNT OF ELECTRIC WIRE) | 100 | 0 | 0 | 100 | 0 |
| CORE EXPOSURE (COUNT OF ELECTRIC WIRE) | 0 | 100 | 100 | 0 | 100 |
| EVALUATION OF INSULATION DISPLACEMENT WORKABILITY | X | X | X | X | X |

| | COMPARATIVE EXAMPLE 6 | COMPARATIVE EXAMPLE 7 | COMPARATIVE EXAMPLE 8 | COMPARATIVE EXAMPLE 9 |
|---|---|---|---|---|
| NUMBER OF CONDUCTOR WIRE(s) | 7 | 7 | 7 | 7 |
| DIAMETER OF CONDUCTOR WIRE(mm) | 0.16 | 0.16 | 0.16 | 0.16 |
| CONDUCTOR SIZE (AWG) | 26 | 26 | 26 | 26 |
| BLEND | BLEND 11 | BLEND 12 | BLEND 13 | BLEND 14 |
| ADDED AMOUNT OF SILANE COMPOUND A (PARTS BY WT.) | 0.8 | 1.5 | 1.7 | 1.8 |
| ELECTRON BEAM DOSE (KGY) | 50 | 100 | 100 | 100 |
| 180-100 × A (KGY) | 100 | 30 | 10 | 0 |
| GEL FRACTION (%) | 61 | 75 | 74 | 77 |
| OUTER DIAMETER OF COVERING LAYER (mm) | 0.98 | 0.98 | 0.98 | 0.98 |
| 100% TENSILE MODULUS Y(MPA) | UNMEASURABLE | 10 | 10 | 9.5 |
| $270-8.5 \times 10^{-6} \times Y$ | — | 185 | 185 | 189 |
| ELONGATION EL (%) | 90 | 180 | 160 | 170 |
| ELECTRIC WIRE NO. | 13 | 14 | 15 | 16 |
| CONNECTOR USED | JST KR | JST KR | JST KR | JST KR |
| COVERING LAYER DEFORMATION (COUNT OF ELECTRIC WIRE) | 0 | 0 | 0 | 0 |
| CORE EXPOSURE (COUNT OF ELECTRIC WIRE) | 100 | 32 | 84 | 78 |
| EVALUATION OF INSULATION DISPLACEMENT WORKABILITY | X | X | X | X |

As shown in Table 4, covering layer deformation occurred in all the electric wires, and insulation displacement workability was found to be poor.

Comparative Example 2

An electric wire (No. 8) was manufactured in the same manners as in Example 1, except that the dose of the electron beam to the resin composition (blend 1) was increased to 300 kGy. Insulation displacement workability of this electric wire was evaluated in the same manners as in Example 4. The result is shown in Table 4. As shown in Table 4, core exposure occurred in all the electric wires, and insulation displacement workability was found to be poor.

Comparative Example 3

An electric wire (No. 9) was manufactured in the same manners as in Example 1, except that a resin composition (blend 7) containing EVA where the weight ration of the vinyl acetate unit (VA) in the ethylene-vinyl acetate copolymer (EVA) was 19 wt % was used. Insulation displacement workability of this electric wire was evaluated in the same manners as in Example 1. The result is shown in Table 4. As shown in Table 4, core exposure occurred in all the electric wires, and insulation displacement workability was found to be poor.

Comparative Example 4

An electric wire (No. 10) was manufactured in the same manners as in Example 1, except that a resin composition (blend 8) containing magnesium hydroxide not surface-treated with a silane compound was used. Insulation displacement workability of this electric wire 10 was evaluated in the same manners as in Example 4. The result is shown in Table 4. As shown in Table 4, covering layer deformation occurred in all the electric wires, and insulation displacement workability was found to be poor.

Comparative Example 5

An electric wire (No. 11) was manufactured in the same manners as in Example 2, except that a resin composition (blend 9) containing the increased amount of γ-methacryloxypropylmethoxysilane was used. Insulation displacement workability of this electric wire was evaluated in the same manners as in Example 1. The result is shown in Table 4. As shown in Table 4, core exposure occurred in all the electric wires, and insulation displacement workability was found to be poor.

Comparative Example 6

An electric wire (No. 13) was manufactured in the same manners as in Example 1, except that a resin composition (blend 11) where the added amount of magnesium hydroxide surface-treated with aminosilane was increased to 260 parts by weight was used. Insulation displacement workability of this electric wire was evaluated in the same manners as in Example 1. The result is shown in Table 4. As shown in Table 4, core exposure occurred in all the electric wires, and insulation displacement workability was found to be poor.

Comparative Example 7

An electric wire (No. 14) was manufactured in the same manners as in Example 1, except that a resin composition (blend 12) containing EVA in which the weight ratio of the vinyl acetate unit (VA) in the ethylene-vinyl acetate copolymer (EVA) was 28 wt %, magnesium hydroxide (200 parts by weight) not surface-treated with a silane compound, and γy-methacryloxypropylmethoxysilane (2 parts by weight), and not containing stearic acid was used, and the dose of the electron beam and gel fraction for the above resin composition were set as shown in Table 4. Insulation displacement workability of this electric wire was evaluated in the same manners as in Example 1. The result is shown in Table 4. As shown in Table 4, no covering layer deformation of the electric wire occurred in all the electric wires, but core exposure occurred highly frequently, and insulation displacement workability was found to be poor.

Comparative Example 8

An electric wire (No. 15) was manufactured in the same manners as in Example 1, except that a resin composition (blend 13) containing EVA in which the weight ratio of the vinyl acetate unit (VA) in the ethylene-vinyl acetate copolymer (EVA) was 28 wt %, magnesium hydroxide not surface-treated with a silane compound (180 parts by weight), and γ-methacryloxypropylmethoxysilane (3 parts by weight), and not containing stearic acid was used, and the dose of the electron beam and gel fraction for the resin composition were set as shown in Table 4. Insulation displacement workability of this electric wire was evaluated in the same manners as in Example 1. The result is shown in Table 4. As shown in Table 4, no covering layer deformation of the electric wire occurred in all the electric wires, but core exposure occurred highly frequently, and insulation displacement workability was found to be poor.

Comparative Example 9

An electric wire (No. 16) was manufactured in the same manners as in Example 1, except that a resin composition (blend 14) containing magnesium hydroxide not surface-treated with a silane compound (170 parts by weight), γ-methacryloxypropylmethoxysilane (3 parts by weight), and 20 parts by weight of basic magnesium carbide, and not containing stearic acid was used, and the dose of the electron beam and gel fraction for the above resin composition were set as shown in Table 4. Insulation displacement workability of this electric wire was evaluated in the same manners as in Example 1. The result is shown in Table 4. As shown in Table 4, no covering layer deformation of the electric wire occurred, but core exposure occurred highly frequently, and insulation displacement workability was found to be poor.

As has been described above, an electric wire according to the present invention is reliably mounted in an insulation displacement connector without deforming the covering layer and the removal of the electric wire once mounted can be prevented, when the electric wire is mounted to the electric wire. Also, exposure of the conductor can be sufficiently prevented because damage to the electric wire can be sufficiently prevented. Therefore, insulation displacement workability of the electric wire to the insulation displacement connector can be performed using an automatic insulation displacement connector without visually checking the insulation displacement performance one by one, thereby greatly increasing insulation displacement performance efficiency of the electric wire.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An electric wire comprising a conductor and a covering layer covering the conductor, the conductor being contactable with two contact portions of a terminal by inserting the electric wire under pressure between said two contact portions of the terminal of an insulation displacement connector, wherein the covering layer is made of a covering material obtained by irradiating with ionizing radiation a resin composition containing an ethylene copolymer, a metal hydroxide, and a silane compound with all of said silane compound surface-treating said metal hydroxide, wherein said silane compound is represented by:

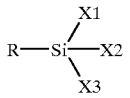

(where R represents an alkyl group having an acrylic, methacrylic, or allyl group, a saturated alkyl group, a vinyl group, an epoxy group, an amino group, or a mercapto group; X1, X2, and X3 represent alkoxy or alkyl groups, respectively; and at least one of X1, X2, and X3 represents an alkoxy group), wherein a 100% tensile modulus of the covering material is not less than 7.8 MPa, and wherein the 100% tensile modulus and an elongation of the covering material satisfies the following relationship $$E1>270-8.5\times10^{-6}\times Y$$

(where E1 is the elongation and Y is the 100% tensile modulus).

2. An electric wire according to claim 1, wherein the 100% tensile modulus of the covering material is not less than 9 MPa.

3. An electric wire according to claim 1, wherein the 100% tensile modulus of the covering material is not less than 10 MPa.

4. An electric wire according to claim 1, wherein the 100% tensile modulus of the covering material is not more than 50 MPa.

5. An electric wire according to claim 1, wherein the metal hydroxide is added by 90 to 250 parts by weight to 100 parts by weight of the ethylene copolymer, and the silane compound is added by 0.2 to 2 parts by weight to 100 parts by weight of the metal hydroxide in the resin composition.

6. An electric wire according to claim 1, wherein a gel fraction in the covering layer of a portion except inorganic substances including the metal hydroxide from the covering material is 55% to 85%.

7. An electric wire according to claim 1, wherein the covering material is obtained by irradiating the resin composition with ionizing radiation of 20 kGy to 130 kGy.

8. An electric wire according to claim 7, wherein the covering material is obtained by irradiating the resin composition with ionizing radiation at a dose of not more than a dose represented by $$(180-100\times A)(\text{kGy})$$

(where A is the added amount (parts by weight) of the silane compound to the metal hydroxide).

9. An electric wire according to claim 1, wherein the ethylene copolymer is at least one material selected from the group consisting of an ethylene-vinyl acetate copolymer, an ethylene-ethyl acrylate copolymer, an ethylene-methyl acrylate copolymer, and an ethylene-α-olefin copolymer.

10. An electric wire according to claim 1, wherein the metal hydroxide is at least one material selected from the group consisting of magnesium hydroxide and aluminum hydroxide.

11. An electric wire and an insulation displacement connector combination comprising:

an insulation displacement connector terminal having two contact portions, and a wire having a conductor and a covering layer covering the conductor, the electric wire contacting the two contact portions of the terminal by insertion of the wire under pressure between the two contact portions of the terminal, wherein the covering layer is made of a covering material obtained by irradiating with ionizing radiation a resin composition containing an ethylene copolymer, a metal hydroxide, and a silane compound with all of the silane compound surface-treating the metal hydroxide, wherein the silane compound is represented by

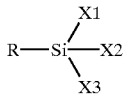

(where R represents an alkyl group having an acrylic, methacrylic, or allyl group, a saturated alkyl group, a vinyl group, an epoxy group, an amino group, or a mercapto group; X1, X2, and X3 represent alkoxy or alkyl groups, respectively; and at least one of X1, X2, and X3 represents an alkoxy group), wherein a 100% tensile modulus of the covering material is not less than 7.8 MPa, and wherein the 100% tensile modulus and an elongation of the covering material satisfies the following relationship $$E1>270-8.5\times10^{-6}\times Y$$

(where E1 is the elongation and Y is the 100% tensile modulus).

12. An electric wire and an insulation displacement connector combination according to claim 11, wherein the 100% tensile modulus of the covering material is not less than 9 MPa.

13. An electric wire and an insulation displacement connector combination according to claim 11, wherein the 100% tensile modulus of the covering material is not less than 10 MPa.

14. An electric wire and an insulation displacement connector combination according to claim 11, wherein the 100% tensile modulus of the covering material is not more than 50 MPa.

15. An electric wire and an insulation displacement connector combination according to claim 11, wherein the metal hydroxide is added by 90 to 250 parts by weight to 100 parts by weight of the ethylene copolymer, and the silane compound is added by 0.2 to 2 parts by weight to 100 parts by weight of the metal hydroxide in the resin composition.

16. An electric wire and an insulation displacement connector combination according to claim 11, wherein a gel fraction in the covering layer of a portion except inorganic substances including the metal hydroxide from covering material is 55% to 85%.

17. An electric wire and an insulation displacement connector combination according to claim 11, wherein the covering material is obtained by irradiating the resin composition with ionizing radiation of 20 kGy to 130 kGy.

18. An electric wire and an insulation displacement connector combination according to claim 17, wherein the covering material is obtained by irradiating the resin composition with ionizing radiation at a dose of not more than a dose represented by $$(180-100\times A)(\text{kGy})$$

(where A is the added amount (parts by weight) of the silane compound to the metal hydroxide).

19. An electric wire and an insulation displacement connector combination according to claim 11, wherein the ethylene copolymer is at least one material selected from the group consisting of an ethylene-vinyl acetate copolymer, an ethylene-ethyl acrylate copolymer, and ethylene-methyl acrylate copolymer, and an ethylene-α-olefin copolymer.

20. An electric wire and an insulation displacement connector combination according to claim 11, wherein the metal hydroxide is at least one material selected from the group consisting of magnesium hydroxide and aluminum hydroxide.

* * * * *